US005492237A

United States Patent [19]

Chang

[11] Patent Number: 5,492,237

[45] Date of Patent: Feb. 20, 1996

[54] EXPANDABLE AND RETRACTABLE MULTIPLE ARTICLE DRYING RACK

[76] Inventor: Kil J. Chang, 321-40 Soksu 2 Dong, Anyang City, Kyunggido, Rep. of Korea

[21] Appl. No.: 288,331

[22] Filed: Aug. 10, 1994

[51] Int. Cl.[6] ..... A47F 5/00

[52] U.S. Cl. ..... 211/202; 211/41; 211/118

[58] Field of Search ..... 211/202, 105, 211/59.1, 118, 41

[56] References Cited

U.S. PATENT DOCUMENTS

| | | | |
|---|---|---|---|
| 639,740 | 12/1899 | Kirby | 211/202 |
| 892,413 | 7/1908 | Freeman | 211/202 X |
| 1,138,498 | 5/1915 | Moore | 211/202 X |
| 2,511,715 | 6/1950 | Kappel | 211/78 |
| 4,364,480 | 12/1982 | Ohno | 211/202 X |
| 4,497,413 | 2/1985 | Tocci | 211/202 |
| 5,221,012 | 6/1993 | Licari | 211/105 |

*Primary Examiner*—Robert W. Gibson, Jr.
*Attorney, Agent, or Firm*—John R. Flanagan

[57] ABSTRACT

A multiple article drying rack includes a base assembly and a plurality of upright posts, a central rod, and a plurality of fingers mounted on the base assembly. The base assembly includes pairs of end support members, a pair of middle support members, and rotary connectors defining substantially parallel rotational axes and pivotally coupling the end support members together, the end support members and middle support members together and the middle support members together so as to define the base assembly as at least a pair of parallelogram structures convertible between erected and collapsed conditions. The upright posts are mounted at lower ends on respective ones of the rotary connectors and extend upwardly therefrom along the rotational axes thereof so as to receive and hold articles, such as baby bottles, in inverted orientations over upper ends of the upright posts. The central rod has a hook on its upper end and is supported at its lower end on a central one of the rotary connectors with a plurality of pins mounted to the rod between its upper and lower ends. The fingers are mounted to the end and middle support members between and spaced from the upright posts mounted by the rotary connectors at opposite ends of the end and middle support members.

19 Claims, 2 Drawing Sheets

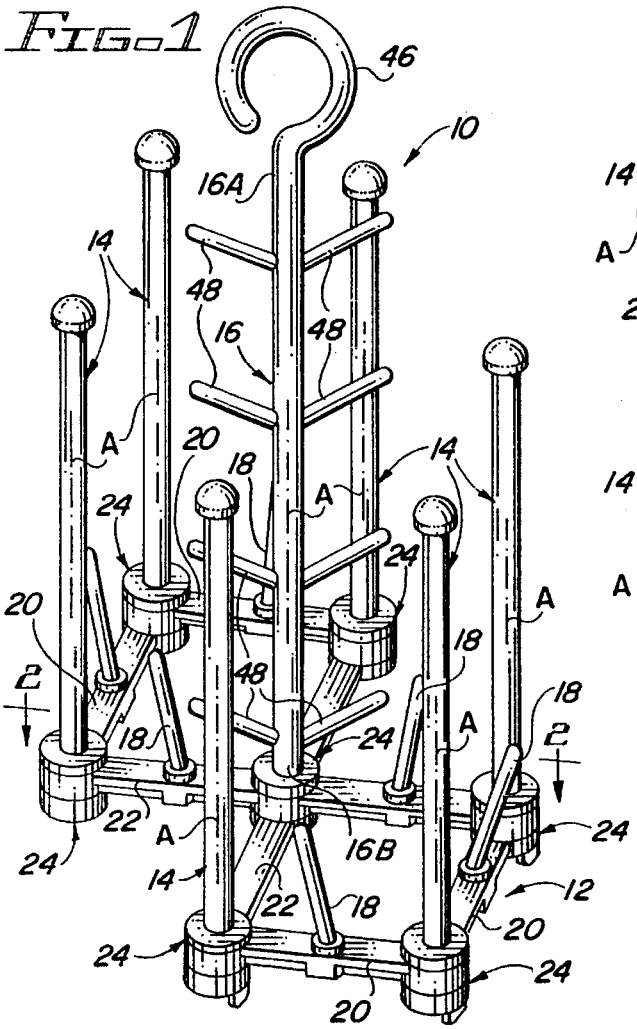
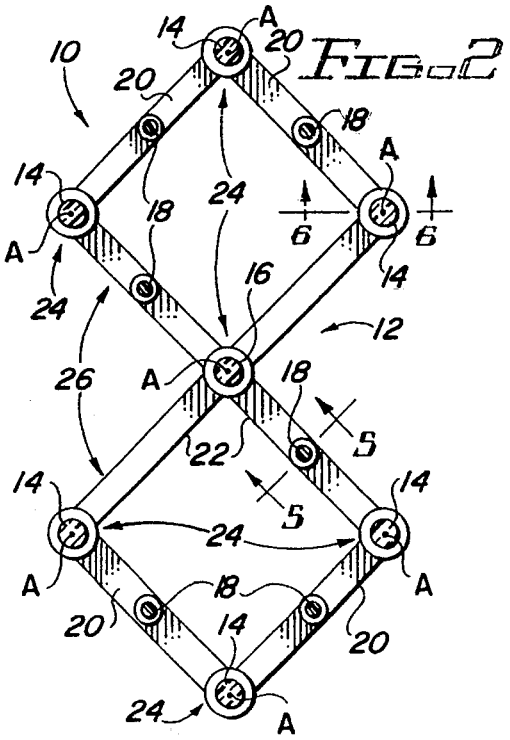
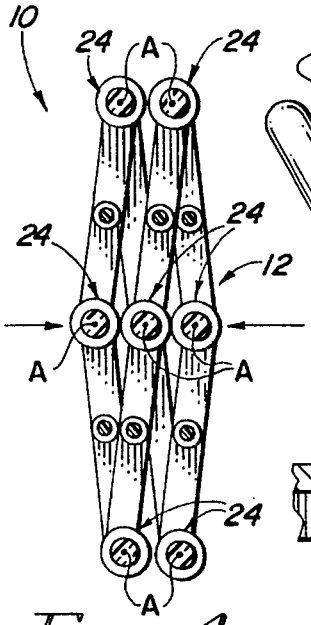
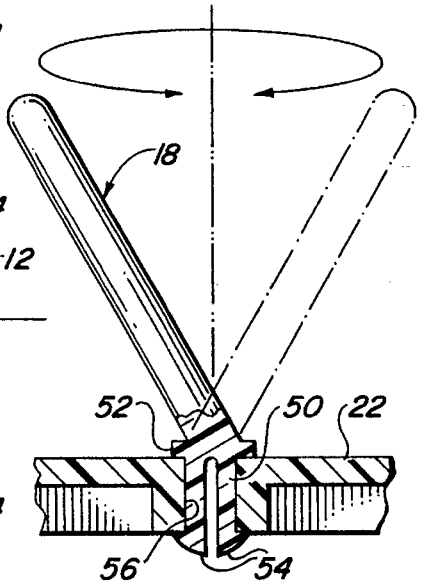
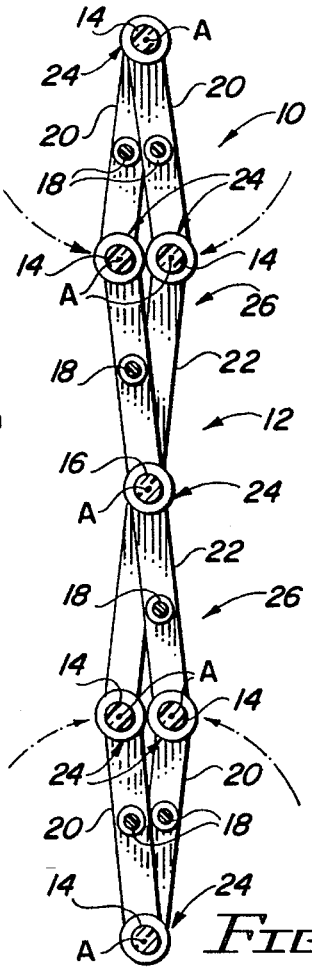
FIG. 4
FIG. 5
FIG. 3

EXPANDABLE AND RETRACTABLE MULTIPLE ARTICLE DRYING RACK

BACKGROUND OF THE INVENTION

1. Field of the Invention

The present invention generally relates to racks upon which articles can be placed for the purpose of air drying and, more particularly, is concerned with an expandable and retractable multiple article drying rack for supporting various articles, for example, various components of a baby bottle assembly, to facilitate air drying thereof.

2. Description of the Prior Art

Reusable articles, such as different types of bottles, are cleansed and sterilized in hot water or other cleansing solutions after each use. One such type of bottle is a reusable baby bottle assembly whose components are taken apart for sterilized cleansing after each use. After sterilized cleansing of the bottles is completed, the bottles or the components thereof are typically supported in an inverted orientation to facilitate draining of any remaining hot water or other cleansing solutions therefrom and to promote cooling and drying of the bottles.

Racks of various designs and constructions for supporting articles such as bottles and baby bottle components in inverted orientations have been proposed in the prior patent art. Representative examples of drying racks are disclosed in U.S. Pat. Nos. to Stepanian (2,419,040), Fromme (2,553,180), Berlener (2,957,585), Gatch (3,255,987), Kassanchuk (4,238,035) and Betts, Sr. (4,485,929) and in French patent to Juniez (771,292).

Of all the aforementioned patented racks, the Kassanchuk rack is the only one specifically designed for drying all of the various components of a baby bottle assembly. This rack has a framework formed by a plurality of U-shaped rods disposed in laterally spaced relation to one another and fixedly retained in such spaced relation by a plurality of horizontal rods being rigidly attached to the U-shaped rods. The components of the baby bottle assembly are supported on the upper ends of the U-shaped rods and within spaces defined between adjacent ones of the horizontal rods.

However, a significant drawback of the Kassanchuk rack is its rigid erected construction which does not allow the rack to be broken down for storage purposes during periods when it is not being used. Consequently, a need still exists for the provision of a drying rack, particularly for baby bottle components, which overcomes the drawback of the Kassanchuk rack without introducing a new drawback in its place.

SUMMARY OF THE INVENTION

The present invention provides an expandable and retractable article drying rack designed to satisfy the aforementioned need. The drying rack of the present invention can be expanded into an erected condition in which the positions of the components forming the rack can be adjustably moved relative to one another so that the volume of space occupied by the erected rack can be varied in size and configuration. On the other hand, the drying rack of the present invention can be retracted into a collapsed condition in which the components forming the rack are positioned in close side-by-side relationship so as to occupy a minimal volume of space for storage purposes. Additionally, the drying rack can be retracted into the collapsed condition in either one of two different configurations which offers flexibility by allowing the selection of the configuration more likely to fit in the storage space available.

Accordingly, the present invention is directed to a multiple article drying rack which comprises a base assembly and a plurality of upright posts mounted on the base assembly. The base assembly is formed by a plurality of elongated end support members each having first and second opposite ends, a plurality of elongated middle support members each having a pair of opposite ends, and a plurality of rotary connectors defining a plurality of substantially parallel rotational axes and pivotally coupling the end support members together, the end support members and middle support members together and the middle support members together so as to define the base assembly as at least a pair of parallelogram structures convertible between erected and collapsed conditions.

The upright posts are mounted at lower ends on respective ones of the rotary connectors and extend upwardly therefrom along the rotational axes thereof so as to receive and hold articles, such as baby bottles in an inverted orientation, over an upper end of the upright post. Each of the upright posts is thereby disposed at a respective one of a plurality of corners defined by the parallelogram structures. The upright posts of each parallelogram structure are arranged as an expanded polygon when the base assembly is disposed in the erected condition and a contracted polygon when the base assembly is converted to the collapsed condition.

The multiple article drying rack of the present invention also comprises a central rod and a plurality of pins mounted to the central rod. The central rod has a hook formed on an upper end of the rod to use to hang and suspend the rack from above. The central rod also has a lower end being mounted on a central one of the rotary connectors pivotally connecting the middle portions of the middle support members. The pins are mounted to the central rod in vertically spaced relationships to one another between upper and lower ends of the central rod. Also, the pins extend at a slight acute angle relative to a horizontal reference line and are adapted to support articles, such as the nipple caps of baby bottle assemblies, over upper ends of the pins.

The multiple article drying rack of the present invention further comprises a plurality of fingers mounted to the elongated end and middle support members between and spaced from the upright posts mounted by the rotary connectors at the opposite ends of the end and middle support members. The fingers extend at a slight acute angle relative to a vertical reference line and are adapted to support articles, such as the nipple cap covers of baby bottle assemblies, over upper ends of the fingers.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of an expandable and retractable multiple article drying rack of the present invention being shown in an erected condition.

FIG. 2 is a plan view of a base assembly of the rack as seen along line 2—2 of FIG. 1.

FIG. 3 is a plan view of the base assembly of the rack similar to that of FIG. 2 but showing the rack in a first configuration of a collapsed condition of the rack.

FIG. 4 is a plan view of the base assembly of the rack similar to that of FIG. 3 but showing the rack in a second configuration of the collapsed condition of the rack.

FIG. 5 is an enlarged fragmentary view of the rack taken along line 5—5 of FIG. 2 showing one of a plurality of pivotal fingers mounted on the base assembly of the rack.

DETAILED DESCRIPTION OF THE INVENTION

Figure 9:
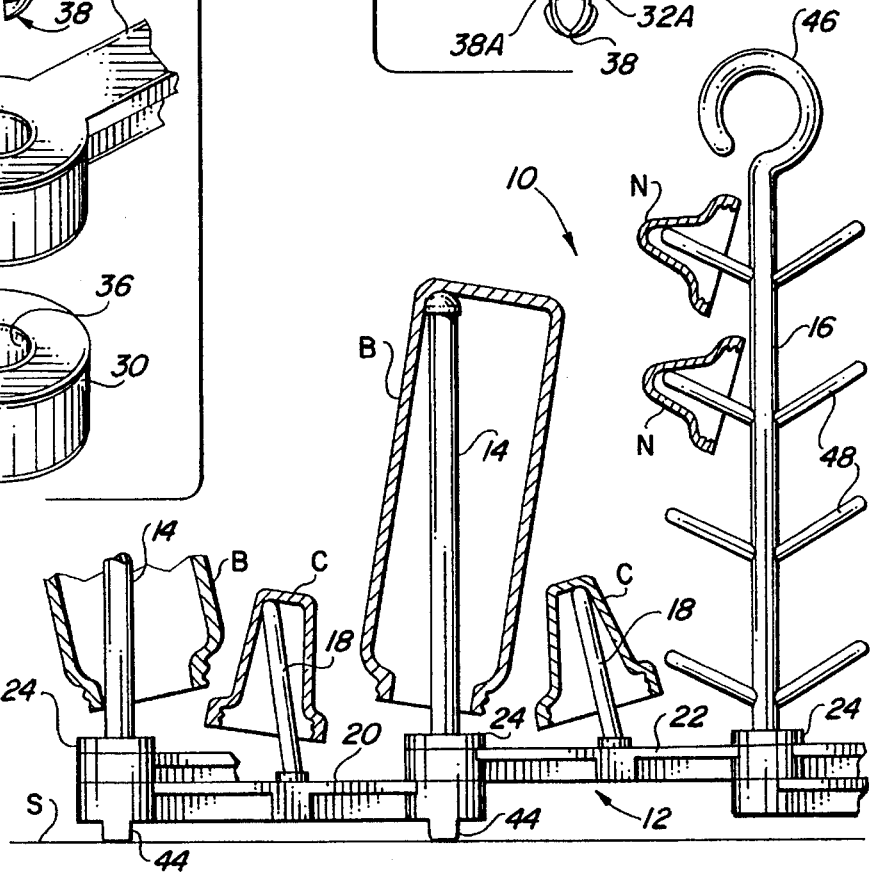
FIG. 9 is an enlarged fragmentary side elevational view of the rack of FIG. 1 showing various components of baby bottle assemblies supported thereon.

Referring to the drawings and particularly to FIGS. 1 and 9, there is illustrated a multiple article drying rack, generally designated 10, constructed in accordance with the principles of the present invention. The rack 10 is designed to support various articles, for example, various components of a baby bottle assembly, to facilitate air drying thereof. As shown in FIG. 9, these components are baby bottles B, nipple caps N and nipple cap covers C. However, it should be understood that the rack 10 can be employed to just support and/or to facilitate drying a wide variety of articles.

Referring to FIG. 1, the multiple article drying rack 10 basically includes a base assembly 12 and a plurality of upright elongated posts 14, an elongated central rod 16, and a plurality of fingers 18, all being mounted on the base assembly 12. The base assembly 12 of the rack 10 is formed by first and second pairs of elongated end support members 20 each having first and second opposite ends 20A, 20B, a pair of elongated middle support members 22 each having a pair of opposite ends 22A, 22B, and a plurality of rotary connectors 24.

Referring to FIGS. 1–4, the rotary connectors 24 of the base assembly 12 define respective rotational axes A extending substantially parallel to one another. The rotary connectors 24 also respectively pivotally couple the end support members 20 together, the end and middle support members 20, 22 together, and the middle support members 22 together so as to define the base assembly 12 in the form of at least a pair of parallelogram structures 26 being convertible between an erected condition, as seen in FIGS. 1 and 2, and a collapsed condition having one or the other of two different configurations, as seen respectively in FIGS. 3 and 4. Some of the rotary connectors 24 are used to pivotally couple the end support members 20 to one another at the first ends 20A thereof, others of the rotary connectors 24 are employed to pivotally couple the second ends 20B of the end support members 20 to the opposite ends 22A, 22B of the middle support members 22, and a final rotary connector 24 is provided to pivotally couple the middle support members 22 to one another at midpoints thereon located between their opposite ends 22A, 22B.

Figure 6:
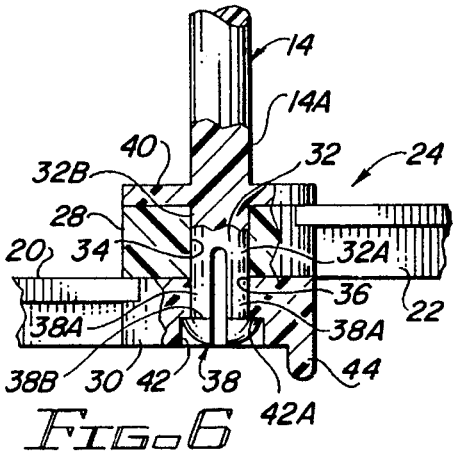
FIG. 6 is another enlarged fragmentary view of the rack taken along line 6—6 of FIG. 2 showing one of a plurality of rotatable connectors of the base assembly of the rack.
Figure 7:
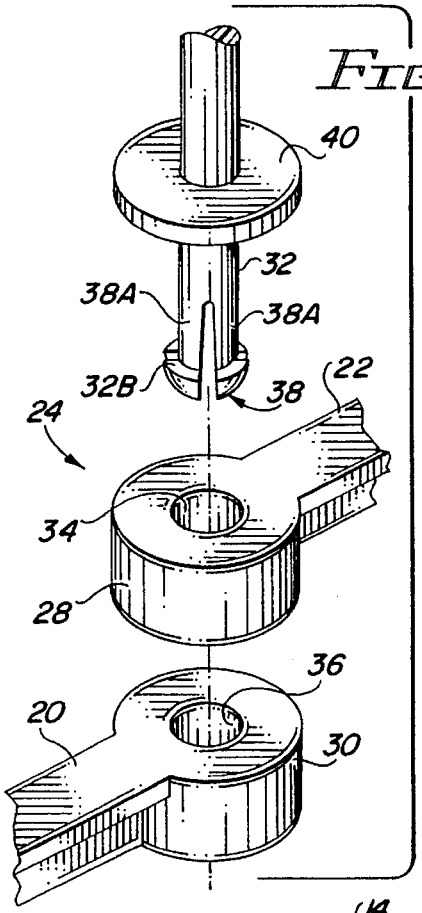
FIG. 7 is an exploded perspective view of the rotatable connector of FIG. 6.

More particularly, referring especially to FIGS. 6 and 7, each rotary connector 24 is made up of a pair of annular upper and lower hubs 28, 30 attached to adjacent ends of the respective end and middle support members 20, 22 such that one hub is disposed above the other hub and a pivot pin 32 extending through central bores 34, 36 formed through the respective hubs 28, 30. The pivot pin 32 has a longitudinally-slotted lower end portion 32A defining an expandable and contractable latch element 38 thereon and an annular stop element 40 defined about and protruding outwardly from an upper end portion 32B thereof. The latch element 38, made up of a plurality of circumferentially spaced resiliently bendable prongs 38A, normally assumes the expanded shape being shown in FIGS. 6 and 7. The latch element 38 is contractable by application of radially inwardly directed force on the prongs 38A to assume an outside diameter size smaller than that of the inside diameters of the bores 34, 36 so as to permit the insertion and removal of the pivot pin 32 through and from the bores of the aligned hubs 28, 30 for assembling and disassembling the rack 10. The automatic expansion of the prongs 38A of the latch element 38 back to an outside diameter size larger than that of the inside diameters of the bores 34, 36 prevents the pivot pins 32 from being removed from the bores while still permitting the pivoting of the hubs 28, 30 and pins 32 relative to one another. Also, a recess 42 is defined in the underside of each of the lower hubs 30 surrounding the lower end of the central bore 36 therein so as to define a downwardly-facing annular shoulder 42A which engage with an upwardly-facing annular ledge 38B defined by the latch element 38 on each pivot pin 32. Also, each rotary connector 24 has an arcuate-shaped foot 44 attached to and extending downwardly from the periphery of the underside of the lower annular hub 30. As seen in FIG. 9, acting together the feet 44 on the rotary connectors 24 support the base assembly 12 in a spaced relation above a support surface S.

Each of the upright posts 14 of the rack 10 is mounted at a lower end 14A, preferably by an integral rigid connection, on the upper end portion 32B of the pivot pins 32 of one of the rotary connectors 24. The upright post 14 extends upwardly therefrom coaxially along the rotational axis A defined by the rotary connector 24 to an upper end 14B. The upright post 14 is adapted to receive and hold an article, such as a baby bottle B (see FIG. 9) in an inverted orientation, over the upper end 14B of the upright post 14. Each of the upright posts 14 is disposed at a respective one of a plurality of corners defined by the parallelogram structures 26. The upright posts of each parallelogram structure 26 define or are arranged in an expanded polygon configuration, as seen in FIGS. 1 and 2, when the base assembly 12 is disposed in the erected condition, whereas they define or are arranged in a contracted polygon configuration, as seen in FIGS. 3 and 4, when the base assembly 12 is converted to the collapsed condition.

Figure 8:
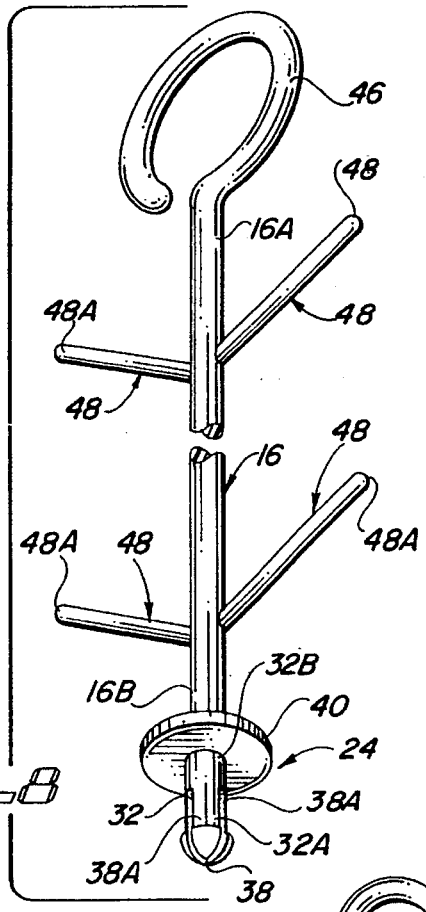
FIG. 8 is an enlarged perspective view of a central rod and plurality of pins of the rack of FIG. 1 being shown removed from the base assembly of the rack.

Referring to FIGS. 1, 8 and 9, the central rod 16 of the rack 10 has a hook 46 formed on an upper end 16A of the rod to use to hang and suspend the rack 10 from above. The central rod 16 also has a lower end 16B being mounted and supported, preferably by an integral rigid connection, on a central one of the rotary connectors 24 which pivotally couples the middle portions of the middle support members 22 together. Further, the central rod 16 supports a plurality of pins 48 along the rod 16. The pins 48 are mounted to the central rod 16 in vertically spaced relationships to one another between the upper and lower ends 16A, 16B thereof. Also, preferably, the pins 48 extend at a slight acute angle relative to a horizontal reference line, adapting them to support the nipple caps N of the baby bottle assemblies over outer or upper ends 48A of the pins 48, as seen in FIG. 9.

Referring to FIGS. 1–5 and 9, the plurality of fingers 18 of the rack 10 are mounted to the elongated end and middle support members 20, 22 between and spaced from the upright posts mounted by the rotary connectors 24 The fingers 18 have longitudinally-slotted lower end portions 18A defining pivot pins 50, upper annular stop elements 52 and lower latch elements 54 substantially similar to those of the rotary connectors 24 described above. The lower end portions 18A of the fingers 18 are thus removably seated through apertures 56 defined in the midpoints of the end support members 20 and the middle support members 22. The upper portions of the fingers 18 extend at a slight acute angle relative to a vertical reference line, adapting them to support the nipple cap covers C of baby bottle assemblies over upper ends 18B of the fingers 18, as seen in FIG. 9.

In summary, referring again to FIGS. 1–4, the multiple article drying rack 10 of the present invention having the above-described construction can be expanded into the erected condition, as seen in FIGS. 1 and 2, in which the positions of the components forming the rack 10 can be adjustably moved relative to one another so that the volume of space occupied by the erected rack 10 can be varied in size and configuration. On the other hand, the drying rack 10 can be retracted into the collapsed condition, as seen in FIGS. 3 and 4, in which the components forming the rack 10 are positioned close to one another in one or the other of two different side-by-side configurations or relationships so as to occupy a minimal volume of space for storage purposes.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A multiple article drying rack, comprising:

(a) a base assembly formed by a plurality of elongated end support members each having first and second opposite ends, a plurality of elongated middle support members each having a pair of opposite ends, and a plurality of rotary connectors defining a plurality of substantially parallel rotational axes and pivotally coupling said end support members together, said end and middle support members together and said middle support members together so as to define said base assembly as at least a pair of parallelogram structures convertible between erected and collapsed conditions, each of said rotary connectors including (i) a pair of annular hubs attached to adjacent ends of said respective end and middle support members such that one hub is disposed above the other hub, (ii) a pivot pin extendable through central bores formed through said hubs, said pivot pin having a lower end portion with at least one longitudinal slot formed therein defining a latch element on said lower end portion of said pivot pin having a plurality of circumferentially spaced resilient prongs being expandable and contractable relative to one another between respective expanded and contracted outside diameter sizes correspondingly larger and smaller than an inside diameter of said central bores of said hubs so as to permit releasable securement of said pivot pin through said central bores of said hubs, and (iii) an annular stop element defined about an upper end portion of said pivot pin for engaging an upper one of said hubs; and (b) a plurality of upright posts each being mounted at a lower end on one of said rotary connectors and extending upwardly therefrom along said rotational axis thereof so as to receive and hold an article over an upper end of said upright post.

2. The rack of claim 1 wherein said plurality of elongated end support members includes first and second pairs of said elongated end support members.

3. The rack of claim 1 wherein said plurality of elongated middle support members includes a pair of said elongated middle support members.

4. The rack of claim 1 wherein said plurality of rotary connectors includes a pair of said rotary connectors pivotally coupling said end support members of each pair thereof to one another at said first ends thereof.

5. The rack of claim 1 wherein said plurality of rotary connectors includes a plurality of pairs of said rotary connectors, said each pair of said rotary connectors pivotally coupling said second ends of said end support members of each pair thereof to said opposite ends of said middle support members of said pair thereof.

6. The rack of claim 1 wherein said plurality of rotary connectors includes one of said rotary connectors pivotally coupling said middle support members of said pair thereof to one another at midpoints thereon located between said opposite ends thereof.

7. The rack of claim 1 wherein said plurality of rotary connectors includes:

a pair of first rotary connectors pivotally coupling said end support members of each pair thereof to one another at said first ends thereof;

a plurality of pairs of second rotary connectors pivotally coupling said second ends of said end support members of each pair thereof to said opposite ends of said middle support members of said pair thereof; and a third rotary connector pivotally coupling said middle support members of said pair thereof to one another at midpoints thereon located between said opposite ends thereof.

8. The rack of claim 1 wherein each of said rotary connectors includes an arcuate-shaped foot attached to and extending downwardly from an underside of a lower one of said pair of annular hubs.

9. The rack of claim 1 wherein each of said upright posts is disposed at a respective one of a plurality of corners defined by said parallelogram structures, said upright posts of each parallelogram structure defining an expanded polygon when said base assembly is disposed in said erected condition and a contracted polygon when said base assembly is converted to said collapsed condition.

10. A multiple article drying rack, comprising:

(a) a base assembly formed by a plurality of elongated end support members each having first and second opposite ends, a plurality of elongated middle support members each having a pair of opposite ends, and a plurality of rotary connectors defining a plurality of substantially parallel rotational axes and pivotally coupling said end support members together, said end and middle support members together and said middle support members together so as to define said base assembly as at least a pair of parallelogram structures convertible between erected and collapsed conditions;

(b) a plurality of upright posts each being mounted at a lower end on one of said rotary connectors and extending upwardly therefrom along said rotational axis thereof so as to receive and hold an article over an upper end of said upright post;

(c) a central rod having an upper end and a lower end supported on a central one of said rotary connectors pivotally connecting said middle portions of said middle support members; and (d) a plurality of pins mounted to said central rod in vertically spaced relationships to one another between said upper and lower ends of said central rod.

11. The rack of claim 10 wherein said central rod has a hook formed on said upper end of said central rod.

12. The rack of claim 11 wherein said pins extend at a slight acute angle relative to a horizontal reference line and are adapted to support articles over upper ends of said pins.

13. The rack of claim 10 wherein said plurality of rotary connectors includes:

a pair of first rotary connectors pivotally coupling said end support members of each pair thereof to one another at said first ends thereof;

a plurality of pairs of second rotary connectors pivotally coupling said second ends of said end support members of each pair thereof to said opposite ends of said middle support members of said pair thereof; and a third rotary connector pivotally coupling said middle support members of said pair thereof to one another at midpoints thereon located between said opposite ends thereof.

14. The rack of claim 10 wherein each of said rotary connectors includes:

a pair of annular hubs attached to adjacent ends of said respective end and middle support members such that one hub is disposed above the other hub;

a pivot pin extendable through central bores formed through said hubs;

an expandable and contractable latch element defined on a lower end portion of said pivot pin to releasably secure said pivot pin through said central bores of said hubs; and an annular stop element defined about an upper end portion of said pivot pin for engaging an upper one of said hubs.

15. The rack of claim 14 wherein each of said rotary connectors includes an arcuate-shaped foot attached to and extending downwardly from an underside of a lower one of said pair of annular hubs.

16. A multiple article drying rack, comprising:

(a) a base assembly formed by a plurality of elongated end support members each having first and second opposite ends, a plurality of elongated middle support members each having a pair of opposite ends, and a plurality of rotary connectors defining a plurality of substantially parallel rotational axes and pivotally coupling said end support members together, said end and middle support members together and said middle support members together so as to define said base assembly as at least a pair of parallelogram structures convertible between erected and collapsed conditions;

(b) a plurality of upright posts each being mounted at a lower end on one of the rotary connectors and extending upwardly therefrom along said rotational axis thereof so as to receive and hold an article over an upper end of said upright post; and (c) a plurality of fingers mounted to said elongated end and middle support members between and spaced from said upright posts mounted by said rotary connectors at said opposite ends of said end and middle support members.

17. The rack of claim 16 wherein said fingers extend at a slight acute angle relative to a vertical reference line and adapted to support articles over upper ends of said fingers.

18. The rack of claim 16 wherein said plurality of rotary connectors includes:

a pair of first rotary connectors pivotally coupling said end support members of each pair thereof to one another at said first ends thereof;

a plurality of pairs of second rotary connectors pivotally coupling said second ends of said end support members of each pair thereof to said opposite ends of said middle support members of said pair thereof; and a third rotary connector pivotally coupling said middle support members of said pair thereof to one another at midpoints thereon located between said opposite ends thereof.

19. A multiple article drying rack, comprising:

(a) a base assembly formed by a plurality of elongated end support members each having first and second opposite ends, a plurality of elongated middle support members each having a pair of opposite ends, and a plurality of rotary connectors defining a plurality of substantially parallel rotational axes and pivotally coupling said end support members together, said end and middle support members together and said middle support members together so as to define said base assembly as at least a pair of parallelogram structures convertible between erected and collapsed conditions;

(b) a plurality of upright posts each being mounted at a lower end on one of said rotary connectors and extending upwardly therefrom along said rotational axis thereof so as to receive and hold an article over an upper end of said upright post, each of said upright posts thereby being disposed at a respective one of a plurality of corners defined by said pair of parallelogram structures, said upright posts of each parallelogram structure defining an expanded polygon when said base assembly is disposed in said erected condition and a contracted polygon when said base assembly is converted to said collapsed condition;

(c) a central rod having a hook formed on an upper end of said rod to use to hang and suspend said dryer from above, said rod having a lower end being supported on a central one of said rotary connectors pivotally connecting said middle portions of said middle support members;

(d) a plurality of pins mounted to said central rod in vertically spaced relationships to one another between upper and lower ends of said central rod; and (e) a plurality of fingers mounted to said end and middle support members between and spaced from said upright posts mounted by said rotary connectors at said opposite ends of said end and middle support members.

* * * * *